US007540797B1

(12) United States Patent
Blanger

(10) Patent No.: US 7,540,797 B1
(45) Date of Patent: Jun. 2, 2009

(54) DEVICE AND BOOT ASSEMBLY FOR PERFORMING A GLIDING SPORT ON WATER USING A BOARD OF THE WATER-SKI TYPE OR THE LIKE

(76) Inventor: Pierre Blanger, Immeuble "le Soleil d'Or", Carrer San Jordi, Pas de la Case (AD)

( * ) Notice: Subject to any disclaimer, the term of this patent is extended or adjusted under 35 U.S.C. 154(b) by 39 days.

(21) Appl. No.: 11/941,152

(22) Filed: Nov. 16, 2007

(51) Int. Cl.
*B63B 36/85* (2006.01)
*A63C 9/081* (2006.01)

(52) U.S. Cl. ..... 441/70; 280/618

(58) Field of Classification Search ..... 441/70
See application file for complete search history.

(56) References Cited

U.S. PATENT DOCUMENTS 4,050,716 A * 9/1977 Kubelka et al. ..... 280/614
5,785,566 A * 7/1998 Blanger ..... 441/70
5,992,872 A * 11/1999 Proctor ..... 280/611
7,216,889 B2 * 5/2007 Haupt ..... 280/618

FOREIGN PATENT DOCUMENTS

FR 2707589 1/1995

* cited by examiner

*Primary Examiner*—Jesus D Sotelo
(74) *Attorney, Agent, or Firm*—Young & Thompson

(57) ABSTRACT

Device for performing a gliding sport on water using a board of the water-ski type or the like, comprising:

at least one board (1) for gliding on water, at least one boot assembly (2) designed to be releasably attached to the board, for a safe connection between the board and at least one foot of a user, and comprising:

a rigid structure (3) comprising at least:

a rigid sole (4) provided with a heel (5), a rigid metatarsal strap (6) provided with means (7) for locking on the user's foot, a rigid rod (8) provided with means (9) for locking around the user's lower leg, and pivotably connected to the heel of said sole, joint means (10) between said rod and the heel of the sole, located in an area corresponding substantially to the user's ankle, a flexible boot (11) arranged inside said rigid structure, means (12) for attachment, with a safety release, of said at least one boot assembly to said at least one board, which device includes at least one first rigid lateral blade (16), arranged at the right or left of said at least one boot assembly, integral by a first end (17) with a point contained in a first area (19) extending from the upper surface (20) of said board to the lower portion (21) of the heel of the rigid structure, and integral by a second end (18) with a point contained in a second area (22) extending around said joint means between the rod and the sole of the rigid structure and including said joint means, This invention also relates to a boot assembly for performing a gliding sport on water using a board of the water-ski type or the like.

25 Claims, 3 Drawing Sheets

DEVICE AND BOOT ASSEMBLY FOR PERFORMING A GLIDING SPORT ON WATER USING A BOARD OF THE WATER-SKI TYPE OR THE LIKE

This invention relates to a device for performing a gliding sport on water using a board of the water-ski type or the like, comprising:

at least one board for gliding on water, at least one boot assembly designed to be releasably attached to the board, for a safe connection between the board and at least one foot of a user, and comprising:

a rigid structure comprising at least:

a rigid sole provided with a heel, a rigid metatarsal strap provided with means for locking on the user's foot, a rigid lower leg portion provided with means for locking around the user's lower leg, and pivotably connected to the heel of said sole, joint means between said lower leg portion and the heel of the sole, located in an area corresponding substantially to the user's ankle, a flexible boot arranged inside said rigid structure, means for attachment, with a safety release, of said at least one boot assembly to said at least one board.

This invention also relates to a boot assembly as defined above.

Such devices and boot assemblies are known, for example from documents FR 2 707 589 or U.S. Pat. No. 5,785,566 in the applicant's name. Such products work very well. However, to further improve the performance of these products, the applicant has developed them so as to offer an enhanced device and assembly.

An objective of this invention is to propose a device or a boot assembly for performing a gliding sport on water using a board of the water-ski type or the like, provided with means for controlling the trajectory of the board, more specifically when turning.

Another objective of this invention is to propose a device or a boot assembly provided with means improving the rigidity of the boot assembly, and more specifically the lateral rigidity so as to obtain a better response time of the board, essentially when turning.

The applicant has noted that the stresses that the user must provide when coming out of a turn, for example in slalom, are very significant due to the fact that the board and a portion of the boot assembly or assemblies are immersed, and, for a brief instant, under the sudden force exerted by the pull cord when coming out of a turn, the user must extract the equipment from the water.

The applicant has also noted, with the devices and boot assembly of the prior art, for example as described above, that the rigid structure of the boot assembly could have a tendency to deform laterally under the significant stresses caused by the user when turning.

This invention is intended to overcome these disadvantages, and to provide other advantages. More specifically, the invention consists of a device for performing a gliding sport on water using a board of the water-ski type or the like, as defined above, wherein it also includes at least one first rigid lateral blade, arranged at the right-hand side or at the left-hand side of said at least one boot assembly, connected by one first end with a point contained in a first area extending from the upper surface of said board to the lower portion of the heel of the rigid structure, and connected by a second end with a point contained in a second area extending around said joint means between the lower leg portion and the sole of the rigid structure and including said joint means.

The rigid lateral blade has a deflection function when it is immersed in water, for example in a turn; thus, the rigid lateral blade must be placed on the side where the equipment goes underwater, or on the side of the direction of the turn, at the right-hand side for a right-hand turn and at the left-hand side for a left-hand turn.

According to an advantageous feature, the device according to the invention also includes a second rigid lateral blade, complementary to said first blade, arranged at the left-hand side or at the right-hand side of said at least one boot assembly, respectively, connected by one first end with a point contained in a first area extending from the upper surface of said board to the lower portion of the heel of the rigid structure, and connected by a second end with a point contained in a second area extending around said joint means between the lower leg portion and the sole of the rigid structure and including said joint means, so that said device includes two rigid blades arranged respectively on each side of said at least one boot assembly.

Thus, this feature gives the device according to the invention a deflection function that is suitable for right- and left-hand turns, as is useful in slalom, in the field of water-skiing, for example. When the equipment has two independent boot assemblies, either mounted on the same ski or mounted respectively on two separate skis, each boot assembly will advantageously be provided with two blades placed laterally to the right-hand side and the left-hand side of the rigid structure, outside of it.

According to an advantageous feature, the first end of said at least one first rigid lateral blade is in contact with the upper surface of said board and is supported on it, either directly or by means of an element interposed between the upper surface of the board and the first end of said blade.

This feature gives the device an increased lateral rigidity of the boot assemblies with respect to the board, due to the fact that the rigid blades constitute lateral reinforcements in contact with the board from an area corresponding exactly or substantially to the user's ankle. Thus, the board will be more responsive and react more precisely to the user's action by means of the boot assemblies.

According to an advantageous feature, said at least one first rigid lateral blade is connected at its first end with the lower portion of the heel of said rigid structure of the boot assembly.

Thus, this feature provides an attachment of the blade to the boot assembly, or more specifically to the rigid structure, so as to simplify the production and safety, with the blade(s) being connected with the boot assembly and extending along the rigid structure without forming a prominent and dangerous projection from the upper surface of the board.

According to an advantageous feature, said at least one first rigid lateral blade is connected at its second end with said joint means of said rigid structure of the boot assembly.

This attachment area enables the blade to be extended further upward by being connected to an element of the boot assembly that does not move with the lower leg portion of the boot assembly.

According to an advantageous feature, said at least one first rigid lateral blade adopts a triangle shape of which the base is connected with said first area and of which the summit is connected with said second area.

According to an advantageous feature, said at least one first rigid lateral blade is connected with said first area by an adjustable connection, so as to enable:

a modification of the verticality of said blade with respect to the upper surface of said board, and a modification of the angle formed by said blade with the longitudinal axis of said board.

This feature makes the device according to the invention adaptable according to the user, who can adjust, preferably before use of the gliding board(s), the position of the blades according to the reaction desired, as will be described in greater detail below with the description of an embodiment of a device according to the invention.

According to an advantageous feature, said adjustable connection allowing for a modification of the angle that said blade forms with the longitudinal axis of said board, is obtained by an adjustable connection of the base of the triangle at two points substantially located at the two ends of said base, respectively.

This feature gives a practical aspect to the adjustment of each blade, by an independent action at each end of the base of the triangle, making it possible to angularly orient this base with respect to the longitudinal axis of the board or the boot assembly.

According to an advantageous feature, said at least one first rigid lateral blade is connected, at its first end, with the heel of said rigid structure of the boot assembly via a semi-rigid brace, conferring elasticity on the adjustable connection.

This feature facilitates adjustment of the position of the blade by playing on the various elastic compressions of the brace, at the various points of connection of the blade. Thus, to change the adjustment, it is simply necessary to compress the connection point more or less, for example by means of a screwing connection.

According to an advantageous feature, said at least one first rigid lateral blade is integral, at its second end, with joint means of the rigid structure of the boot assembly, via a complete rigid connection.

This feature makes the production of the device according to the invention simple. Indeed, insofar as the lower end of the blade is adjustable in position, the upper end can be rigidly connected to the rigid structure of the boot assembly, and the adjustment of the position of the blade is made possible by a certain flexibility thereof in spite of its rigidity, due to the blade shape.

According to an advantageous feature, said at least one first rigid lateral blade is made of a light metal alloy or a material comprising carbon.

According to an advantageous feature, said at least one first rigid lateral blade extends between said first and second connection areas at a distance from the rigid structure.

This feature makes it possible to control the flow of fluid between the rigid structure and the blade so as to obtain deflection effects as needed.

This invention also relates to a boot assembly for performing a gliding sport on water using a board, of the water-ski type or the like, comprising:

a rigid structure including at least:

a rigid sole provided with a heel, a rigid metatarsal strap provided with means for locking on the user's foot, a rigid lower leg portion provided with means for locking around the user's lower leg, and pivotably connected to the heel of said sole, joint means between said lower leg portion and the heel of the sole, located in an area corresponding substantially to the user's ankle, a flexible boot arranged inside said rigid structure, wherein said boot assembly includes at least one first rigid lateral blade, arranged at the right-hand side or at the left-hand side of said rigid structure, connected by one first end with the lower portion of the heel of the rigid structure, and connected by a second end with a point contained in a second area extending around said joint means between the lower leg portion and the sole of the rigid structure and including said joint means.

The boot assembly according to the invention proposes a practical solution for implementing the device according to the invention, according to which the blade(s) is (are) integrally connected to the rigid structure of the boot assembly.

According to another feature, the boot assembly according to the invention also includes a second rigid lateral blade, complementary to said first blade, arranged to the left-hand side or to the right-hand side of said rigid structure, respectively, connected by one first end with the lower portion of the heel of the rigid structure, and connected by a second end with a point contained in a area extending around said joint means between the lower leg portion and the sole of the rigid structure and including said joint means, so that said boot assembly includes two rigid blades arranged respectively on each side of it.

Other features and advantages will appear on reading the following example of an embodiment of a device and a boot assembly according to the invention, accompanied by appended drawings, with a non-limiting illustrative example.

The device shown in the figures is more specifically intended for the practice of water-skiing, on one ski or on two skis. It should be noted that a single boot assembly has been shown in FIG. 1: to perform single-ski water-skiing, it is appropriate to consider that two boot assemblies identical to that shown in FIG. 1 or 3 can be attached one behind the other in a known manner, advantageously by means of attachments with safety releases.

Figure 1:
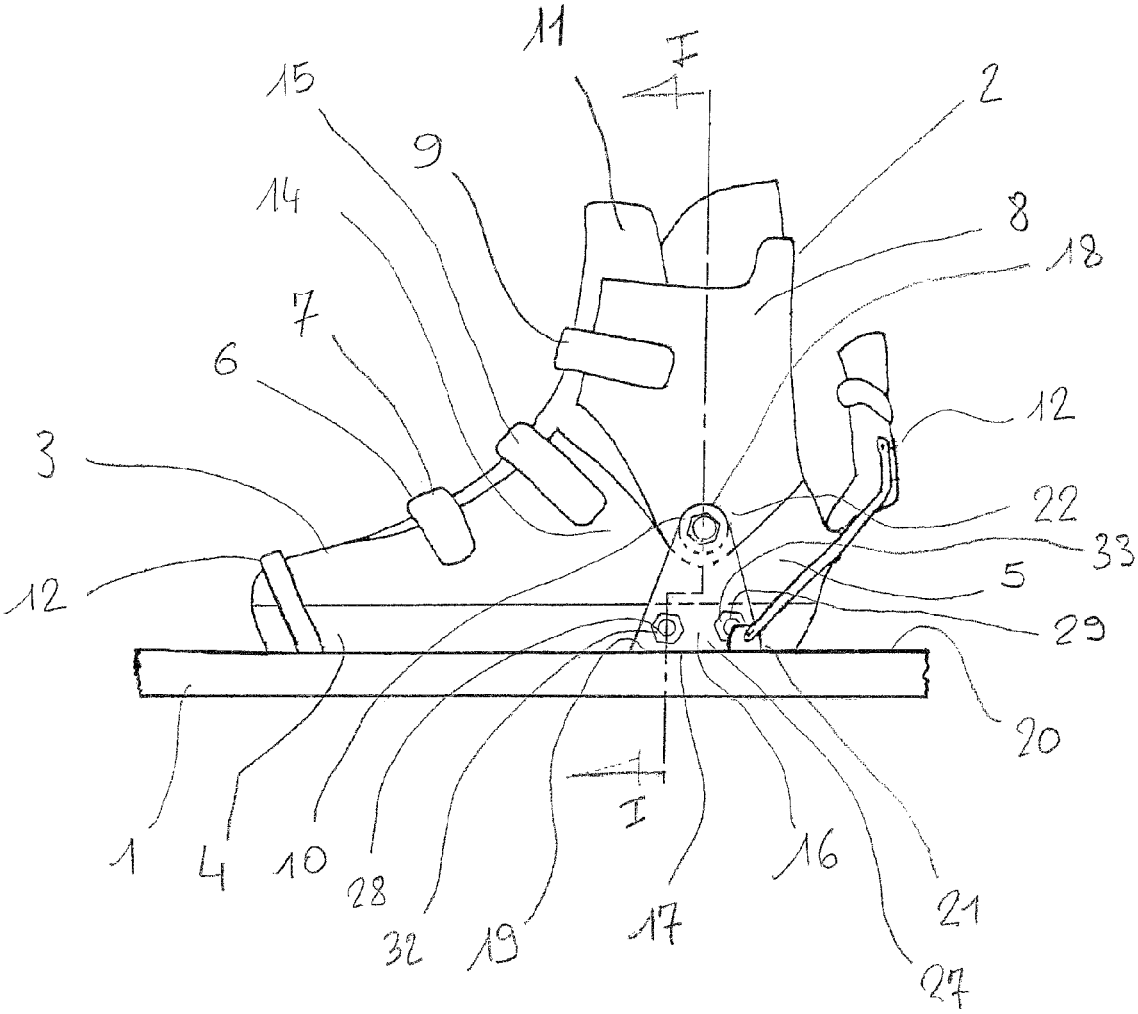
FIG. 1 shows a diagrammatic side view of an embodiment of a device according to the invention, for performing a gliding sport on water by means of a board.
Figure 2:
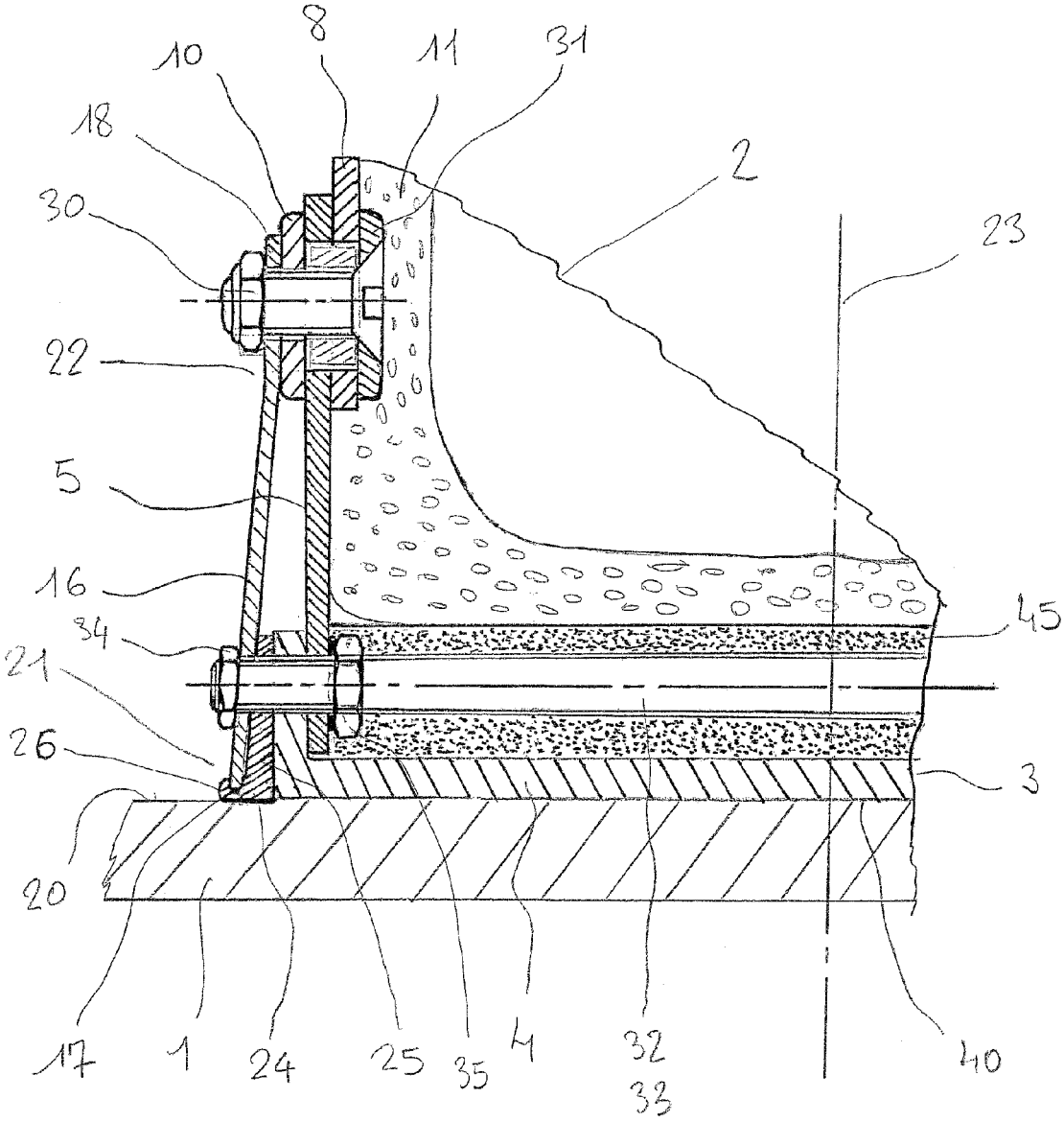
FIG. 2 shows a partial cross-section view along line I-I of FIG. 1.

The device shown in FIGS. 1 and 2 includes:

at least one board 1 for gliding on water, at least one boot assembly 2 designed to be releasably attached to the board 1, for a safe connection between the board 1 and at least one foot of a user (not shown), and comprising, in a known manner:

a rigid structure 3 comprising at least:

a rigid sole 4 provided with a heel 5, a rigid metatarsal strap 6 provided with means 7 for locking on the user's foot, advantageously, a rigid strap 14 over the instep, provided with means for locking 15 on the user's foot, a rigid lower leg portion 8 provided with means 9 for locking around the user's lower leg, and pivotably connected to the heel 5 of said sole 4, joint means 10 between the lower leg portion 8 and the heel 5 of the sole 4, located in an area corresponding substantially to the user's ankle, a flexible boot 11 arranged inside the rigid structure 3, means 12 for attachment, with a safety release, of the boot assembly 2 to the board 1.

It is possible to cite, for example, documents FR 2 707 589 or U.S. Pat. No. 5,785,566, of which the content is entirely integrated in this description for the description of the prior art on which this invention is based. This prior art, constituted by known equipment for connecting a skier to at least one water-ski, will not therefore be described here in greater detail.

We will simply provide a few precisions on the possible production of the boot assembly according to the known prior art, as shown in FIG. 2: the rigid structure 3 can comprise a U-shaped sole 4 with an internal U-shaped filling 45 of very dense polyurethane foam or hard rubber. The heel 5, as well as all of the rigid parts of the rigid structure 3 can be made of carbon or plastic.

According to the invention, the device shown in FIGS. 1 and 2 preferably includes two first 16 and second (not shown) rigid lateral blades, respectively arranged at the right-hand side and at the left-hand side of the boot assembly 2, with each blade being connected by one first end 17 with a point contained in a first area 19 extending from the upper surface 20 of the board 1 to the lower portion 21 of the heel 5 of the rigid structure 3, and connected by a second end 18 with a point contained in a second area 22 extending around said joint means 10 between the lower leg portion 8 and the sole 4 of the rigid structure 3 and including said joint means, so that the device includes two rigid blades arranged respectively on each side of the boot assembly.

FIG. 1 shows the first blade 16 placed at the left-hand side of a boot assembly, for example a left-hand boot assembly as shown in FIG. 1. FIG. 2 shows the left-hand portion of the device in a cross-section, therefore showing the left-hand blade and essentially the boot assembly in a partial transverse cross-section. It should be noted that the cross-section of the right-hand portion of the device of FIG. 1, in the cross-section plane along line I-I, comprising the right-hand blade, is symmetrical in FIG. 2, with respect to a vertical plane 23 passing through the longitudinal axis of the boot assembly 2 shown in FIG. 1. The right- and left-hand rigid lateral blades are thus advantageously identical.

Then, the first left-hand rigid lateral blade 16 shown is described. The right-hand blade (not shown) is obtained identically by symmetry with respect to the vertical plane 23.

Advantageously, the first end 17 of the first rigid lateral blade 16 is in contact with the upper surface 20 of the board 1 and comes into contact with it, either directly, as shown by means of an element 24 interposed between the upper surface 20 of the board 1 and the first end 17 of the blade 16. The rigid lateral blade 16 is preferably connected, at its first end, with the heel 5 of the rigid structure 3 of the boot assembly 2 via a semi-rigid brace 25, for example made of rubber, conferring elasticity on the connection of the blade to the boot assembly. This semi-rigid brace 25, preferably having a lip 26 for contact of the blade 16 on the ski, as shown in FIG. 2, represents an example of an interposed element 24.

Figure 3:
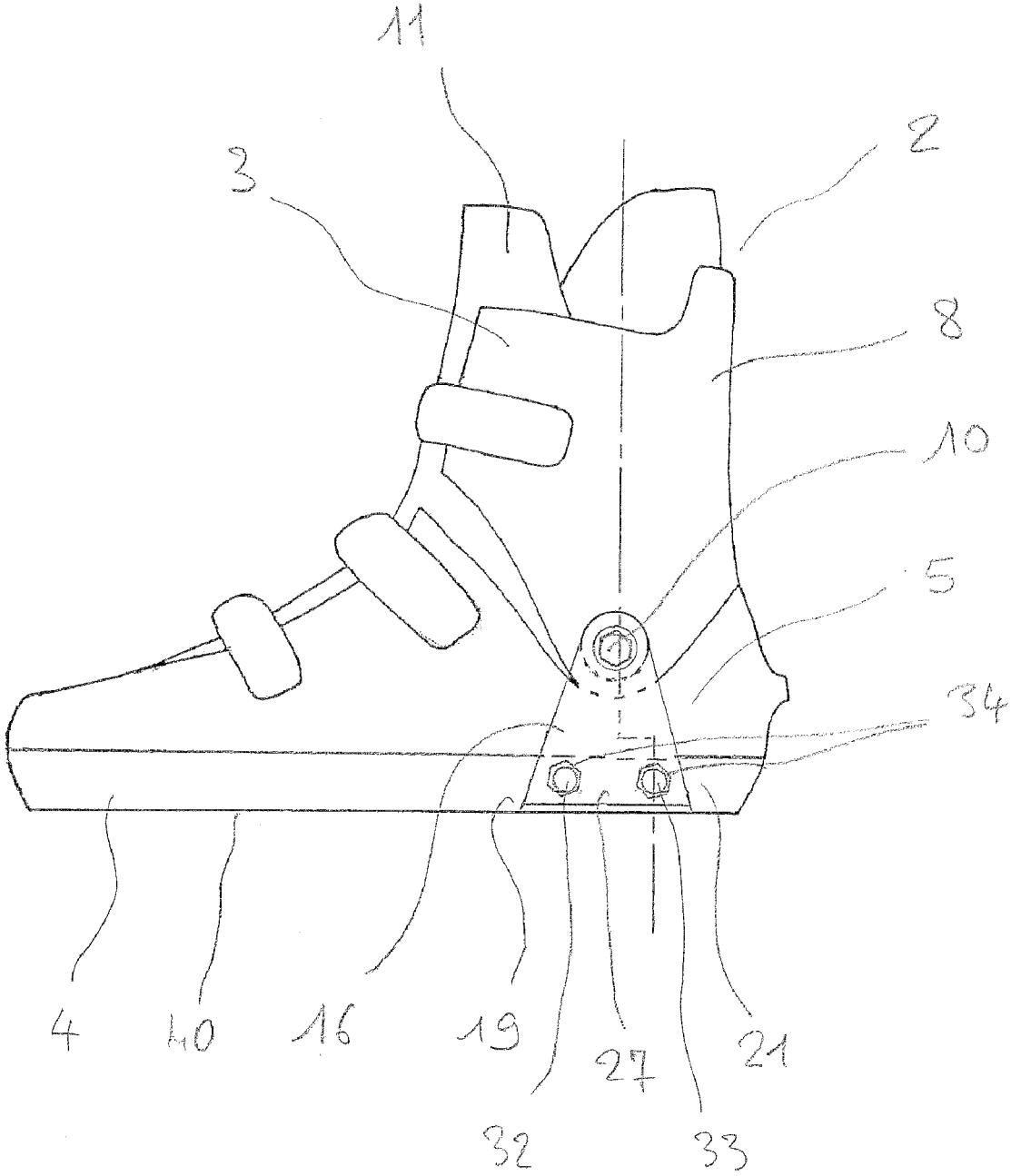
FIG. 3 shows a diagrammatic side view of the boot assembly of FIG. 1, isolated from the device.

Advantageously, as shown in FIG. 3, the first rigid lateral blade 16 is connected at its first end 17 with the lower portion 21 of the heel 5 of the rigid structure 3 of the boot assembly 2, and is connected at its second end 18 with joint means 10 of the rigid structure of the boot assembly 2.

The rigid lateral blade 16 preferably adopts a triangular plate shape of which the base is connected with the first area 19 and of which the summit is integral with the second area 22. Advantageously, the first rigid lateral blade 16 is connected with the first area 19 by an adjustable connection, so as to enable:

a modification of the verticality of the blade 16 with respect to the upper surface 20 of the board 1, and a modification of the angle that the blade 16 forms with the longitudinal axis of the board 1.

This adjustable connection is preferably obtained by an adjustable connection of the base 27 of the triangle at two points 28, 29, substantially located at the two ends of the base 27, respectively, as shown in FIGS. 1 and 3. The blade 16 is preferably connected, at its second end 18, with joint means 10 of the rigid structure of the boot assembly, via a complete rigid connection, for example a bolted connection 30, passing through the rivet 31 for joint of the lower leg portion 8 of the rigid structure 3 of the boot assembly 2, as shown in FIG. 2.

It should be noted that the joint connection with the rivet 31, showing a preferred embodiment of the joint means 10 of the lower leg portion 8 on the heel 5 of the rigid sole 4, is conventional. Such a rivet 31 is located respectively at the right-hand side or at the left-hand side of a conventional rigid structure 3, substantially at the level of the user's ankles, and the right-hand blade and the left-hand blade 16 can thus be attached to the rigid structure 3 in the second area in the same way. The bolt 31 enabling the upper end of the blade 16 to be received passes through the rivet 31 and thus maintains the pivoted connection between the lower leg portion and the sole. It should be noted that any other means for attachment of the blade 16 in the upper portion, maintaining the functionality of the joint means 10, are suitable. It should be noted that the connection of the blade in the second area 22 can leave a degree of freedom in rotation for the blade 16 about the joint axis of the joint means 10, which will be inactive due to the two attachment points of the blade 16 in the first area 19, as described below. Alternatively, the rivet 31 existing on the conventional boot assemblies can be removed and replaced by a suitable bolt performing the two combined joint functions of the lower leg portion 8 and attachment of the upper end of the blade 16. The suitable bolt can advantageously comprise an adjusting washer arranged between the external surface of the rigid structure 3 and the blade 16 so as to determine the separation of the latter with respect to the surface of said rigid structure, according to need.

The base of the blade 16 can be attached to the lower portion 21 of the rigid structure 3 by two threaded rods 32, 33, advantageously identical, passing through the rigid sole 4 in a direction perpendicular to the longitudinal axis of the boot assembly 2, parallel to the surface of the board 1, so as to enable the two right and left blades of a boot assembly to be received. The threaded rods 32, 33 pass through the boot assembly 2 in the body of the sole 4, and more specifically the filling 45 and the two vertical returns of the U shape, so that they do not adversely affect the user's comfort, preserving the space for the flexible inner boot 11. The portion of each rod 32, 33 that projects beyond the external surface of the rigid structure 3 makes it possible to screw a nut 34, with the blade being moved between the nut 34 and the rigid structure 3, via a through-hole for each rod.

For effective tightening of each blade with the nuts 34, a bearing nut 35 can be arranged on each rod in the sole 4, at the right-hand and left-hand sides behind the rigid structure 3, in the space of the sole filled by the filling 35, as shown in FIG. 2 for the left-hand side.

Thus, such an assembly of the blade 16 in the lower portion thereof makes it possible to reinforce the structure of the boot assembly, insofar as the threaded rods sandwich the U-shaped portion of the sole 4, with the bottom of the associated heel 5, the brace 25 and the blade 16, at the right-hand side and the left-hand side of the boot assembly 2, constituting a particularly compact assembly.

Advantageously, the semi-rigid brace 25, arranged between the blade 16 and the rigid structure 3, at each point of attachment of a blade in its lower portion, makes it possible to differentiate the distance existing after each tightening between the blade 16 and the rigid structure 3 at each end of the base of the blade, so as to modify the angle formed by the blade 16 and the longitudinal axis of the board 1. This differentiation is obtained by a more or less significant compression of the brace 25 at each attachment point.

For example, if the "bottom front attachment" of a blade corresponds to that performed by means of the front rod 32 in FIG. 1 or 3, and the "bottom rear attachment" of a blade corresponds to that performed by means of the rear rod 33 in FIG. 1 or 3, it will be possible by fastening the front attachment more tightly than the rear attachment, bringing closer the front of the blade 16 of the rigid structure 3 than the rear of the blade, thus forming with the blade a deflector that opens backwards so as to push the boot assembly 2 or the immersed portion of the ski containing the blade 16 thus positioned out of the water. Such a condition will advantageously occur so as to remove the equipment from the water as quickly as possible after a turn, when the user is turning to the left and the previous adjustment has been performed on the left-hand blade of the left-hand boot assembly and on the left-hand blade of the right-hand boot assembly, as the case may be.

Conversely, if the bottom front attachment of the blade 16 is less tightly fastened than the bottom rear attachment of the same blade, the blade forms a deflector that opens forward so as to push the boot assembly 2 or the immersed portion of the ski containing the blade 16 thus positioned into the water. This condition causes a braking action on the side on which the equipment is immersed, which can, for example, create a shorter radius of curvature in a turn, if a sharp turn is made before a quick exit from the water.

The adjustments are to be determined by each user according to his/her course objectives, experience and personal fit. A number of standard adjustments are possible, for example as described below, in a non-limiting manner:

neutral position: the right-hand and left-hand blades of a boot assembly are parallel to the longitudinal axis of the boot assembly and the board; the reaction of the deflectors is neutral and the main function of the blade is a stiffening function;

open position: the two blades of a boot assembly are closer to the rigid structure in the front and further away at the rear; the reaction of the deflectors will cause a quicker exit from the water in right- and left-hand turns; the stiffening function is ensured;

left- or right-hand braking function: the blade on the side on which braking is required is spaced apart from the rigid structure at the front and brought closer at the rear;

a combination of the aforementioned left- and right-hand configurations can be considered.

The blade 16 is advantageously made of a light metal alloy or a material comprising carbon. It should be rigid enough not to be deformed under hydraulic pressure, for a given adjustment, but should advantageously have a certain elastic deformability to enable the adjustments to be cancelled and new adjustments to be set, simply by screwing or unscrewing nuts 34 at the right-hand and left-hand side of a boot assembly, preferably locknuts, of the plastic ring type, for example. Insofar as the blade 16 is not or is only slightly elastically deformable, it is possible to provide a semi-rigid upper attachment of the type described for the lower portion of the blade.

The blade 16 preferably extends between the first 19 and second 22 connection areas at a distance from the rigid structure 3, as shown in FIG. 2. The blade 16 can become increasingly distant as it extends from the second area 22 to the first area 19, as shown in FIG. 2, thus forming a stiffener so much the more rigid as it is inclined upon moving away from the structure towards the board.

FIG. 3 shows the boot assembly of FIG. 1, separated from the board 1 by releasing the safety-release attachments 12. The preferred solution for the attachment of the blades is to associate them with the boot assembly as described above in reference to FIG. 2. Thus, it is noted that the first end 17 of the rigid lateral blade 16 is flush with, or extends beyond, the lower surface 40 of the sole 4 of the rigid structure 3. If an element 24 is present between the upper surface of the board 1 and the first end 17 of the blade 16, the end of the intermediate element 24 will be flush or will extend beyond the lower surface 40 of the sole 4 of the rigid structure 3, so that this element 24 can be properly interposed between the blade and the surface of the board while providing rigid support of the blade. If the sole of the boot assembly is partially raised with respect to the surface of the ski, for example by safety attachments, the size of the blade should be taken into account so that it extends beyond the sole in order to compensate for this rise and so that the blade is advantageously directly or indirectly in contact with the surface of the board.

The invention claimed is:

1. Device for performing a gliding sport on water using a board, comprising;

at least one board (1) for gilding on water, at least one boot assembly (2) designed to be releasably attached to the board, for a safe connection between the board and at least one foot of a user, and comprising:

a rigid structure (3) comprising at least:

a rigid sole (4) provided with a heel (5), a rigid metatarsal strap (6) provided with means (7) for locking on the user's foot, a rigid lower leg portion (8) provided with means (9) for locking around the user's lower leg, and pivotably connected to the heel of said sole, joint means (10) between said lower leg portion and the heel of the sole, located in an area corresponding substantially to the user's ankle, a flexible boot (11) arranged inside said rigid structure, means (12) for attachment, with a safety release, of said at least one boot assembly to said at least one board, wherein the device includes at least one first rigid lateral blade (16), arranged at the right-hand side or at the left-hand side of said at least one boot assembly, connected by one first end (17) with a point contained in a first area (19) extending from the upper surface (20) of said board to the lower portion (21) of the heel of the rigid structure, and integral by a second end (18) with a point contained in a second area (22) extending around said joint means between the lower leg portion and the sole of the rigid structure and including said joint means.

2. Device according to claim 1, further comprising:

a second rigid lateral blade, complementary to said first blade, arranged at the left-hand side or at the right-hand side of said at least one boot assembly (2), respectively, connected by one first end (17) with a point contained in a first area (19) extending from the upper surface (20) of said board (1) to the lower portion (21) of the heel (5) of the rigid structure (3), and connected by a second end (18) with a point contained in a second area (22) extending around said joint means (10) between the lower leg portion (8) and the sole (4) of the rigid structure (3) and including said joint means, so that said device includes two rigid blades arranged respectively on either side of said at least one boot assembly (2).

3. Device according to claim 1, wherein the first end (17) of said at least one first rigid lateral blade (16) contacts the upper surface (20) of said board (1) and is supported thereon, either directly or by means of an element (24) interposed between the upper surface of the board and the first end of said blade.

4. Device according to claim 1, wherein said at least one first rigid lateral blade (16) is connected at its first end (17)

with the lower portion (21) of the heel (5) of said rigid structure (3) of the boot assembly (2).

5. Device according to claim 1, wherein said at least one first rigid lateral blade (16) is connected at its second end (18) with said joint means (10) of said rigid structure (3) of the boot assembly (2).

6. Device according to claim 1, wherein said at least one first rigid lateral blade (16) is in the shape of a triangle of which the base (27) is connected with said first area (19) and of which the summit is connected with said second area (22).

7. Device according to claim 6, wherein said at least one first rigid lateral blade (16) is connected with said first area (19) by an adjustable connection, so as to enable:

a modification of the verticality of said blade with respect to the upper surface (20) of said board (1), and a modification of the angle formed by said blade with the longitudinal axis of said board.

8. Device according to claim 7, wherein said adjustable connection allowing for a modification of the angle that said blade (16) forms with the longitudinal axis of said board (1), is obtained by an adjustable connection of the base (27) of the triangle at two points substantially located at the two ends of said base, respectively.

9. Device according to claim 7, wherein said at least one first rigid lateral blade (16) is connected, at its first end (17), with the heel (5) of said rigid structure (3) of the boot assembly (2) via a semi-rigid brace (25), providing elasticity on the adjustable connection.

10. Device according to claim 1, wherein said at least one first rigid lateral blade (16) is connected, at its second end (18), with joint means (10) of the rigid structure (3) of the boot assembly (2), via a full rigid connection.

11. Device according to claim 1, wherein said at least one first rigid lateral blade (16) is made of a light metal alloy or a material comprising carbon.

12. Device according to claim 1, wherein said at least one first rigid lateral blade (16) extends between said first (19) and second (22) connection areas at a distance from the rigid structure.

13. Device according to claim 1, wherein said at least one first rigid lateral blade (16) is integral with said first area (19) by an adjustable connection, so as to enable:

a modification of the verticality of said blade with respect to the upper surface (20) of said board (1), and a modification of the angle formed by said blade with the longitudinal axis of said board.

14. Boot assembly (2) for performing a gliding sport on water using a board (1), comprising:

a rigid structure (3) including at least:

a rigid sole (4) provided with a heel (5), a rigid metatarsal strap (6) provided with means (7) for locking on the user's foot, a rigid lower leg portion (8) provided with means (9) for locking around the user's lower leg, and pivotably connected to the heel of said sole, joint means (10) between said lower leg portion and the heel of the sole, located in an area corresponding substantially to the user's ankle, a flexible boot (11) arranged inside said rigid structure, wherein said boot assembly comprises at least one first rigid lateral blade (16), arranged at the right-hand side or at the left-hand side of said rigid structure, connected by one first end (17) with the lower portion (21) of the heel of the rigid structure, and connected by a second end (18) with a point contained in a second area (22) extending around said joint means between the rod and the sole of the rigid structure and including said joint means.

15. Boot assembly according to claim 14, further comprising a second rigid lateral blade, complementary to said first blade, arranged to the left-hand side or to the right-hand side of said rigid structure (3), respectively, connected by a first (17) end with the lower portion (21) of the heel of the rigid structure (3), and connected by a second (18) end with a point contained in an area (22) extending around said joint means (10) between the lower leg portion (8) and the sole (4) of the rigid structure (3) and including said joint means, so that said boot assembly (2) includes two rigid blades arranged respectively on each side of it.

16. Boot assembly according to claim 14 wherein the first end (17) of said at least one first rigid lateral blade (16) is flush with, or extends beyond the lower surface (40) of the sole (4) of said rigid structure (3).

17. Boot assembly according to claim 14, wherein said first rigid lateral blade (16) is connected at its second end (18) with said joint means (10) of said rigid structure (3).

18. Boot assembly according to claim 14, wherein said at least one first rigid lateral blade (16) is in the shape of a triangle of which the base (27) is connected with said lower portion (21) of the heel (5) of the rigid structure (3) and of which the summit is connected with said area (22) extending around said joint means (10) between the lower leg portion (8) and the sole (4) of the rigid structure (3) and including said joint means (10).

19. Boot assembly according to claim 18, wherein said at least one first rigid lateral blade (16) is connected with said lower portion (21) of the heel (5) of the rigid structure (3) by an adjustable connection, so as to enable:

a modification of the verticality of said blade with respect to the axis of the rod (8) of the 25 rigid structure, and a modification of the angle formed by said blade with the longitudinal axis of the sole (4) of said rigid structure.

20. Boot assembly according to claim 19, wherein said adjustable connection allowing for a modification of the angle that said blade (16) forms with the longitudinal axis of the sole (4) of said rigid structure (3) is obtained by an adjustable connection of the base (27) of the triangle at two points substantially located at the two ends of said base, respectively.

21. Boot assembly according to claim 19, wherein said at least one first rigid lateral blade (16) is connected, at its first end (17), with the heel (5) of said rigid structure (3) of the boot assembly (2) via a semi-rigid brace (25), providing elasticity on the adjustable connection.

22. Boot assembly according to claim 14, wherein said at least one first rigid lateral blade (16) is connected, at its second end (18), with joint means (10) of the rigid structure (3), via a full rigid connection.

23. Boot assembly according to claim 14, wherein said at least one first rigid lateral blade (16) is made of a light metal alloy or a material comprising carbon.

24. Boot assembly according to claim 14, wherein said at least one first rigid lateral blade (16) extends between the lower portion (21) of the heel (5) of the rigid structure (3) and the connection area (22) extending around said joint means (10) between the lower leg portion (8) and the sole (4) of the rigid structure (3) and including said joint means (10), at a distance from the rigid structure.

25. Boot assembly according to claim 14, wherein said at least one first rigid lateral blade (16) is connected with said lower portion (21) of the heel (5) of the rigid structure (3) by an adjustable connection, so as to enable:

a modification of the verticality of said blade with respect to the axis of the lower leg portion (8) of the 25 rigid structure, and a modification of the angle formed by said blade with the longitudinal axis of the sole (4) of said rigid structure.

* * * * *